US011025001B2

(12) United States Patent
Andresen

(10) Patent No.: US 11,025,001 B2
(45) Date of Patent: Jun. 1, 2021

(54) PLUG-IN CONNECTOR PART HAVING MODULAR CONTACT INSERTS INSERTED INTO A HOLDING FRAME

(71) Applicant: Phoenix Contact GmbH & Co. KG, Blomberg (DE)

(72) Inventor: Jens Andresen, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 217 days.

(21) Appl. No.: 16/088,824

(22) PCT Filed: Apr. 3, 2017

(86) PCT No.: PCT/EP2017/057854

§ 371 (c)(1),
(2) Date: Sep. 27, 2018

(87) PCT Pub. No.: WO2017/182257

PCT Pub. Date: Oct. 26, 2017

(65) Prior Publication Data

US 2020/0303866 A1 Sep. 24, 2020

(30) Foreign Application Priority Data

Apr. 21, 2016 (DE) ..... 10 2016 107 412.8

(51) Int. Cl.
*H01R 13/514* (2006.01)
*H01R 13/506* (2006.01)
(Continued)

(52) U.S. Cl.
CPC ..... *H01R 13/514* (2013.01); *H01R 13/506* (2013.01); *H01R 13/516* (2013.01); *H01R 13/518* (2013.01); *H01R 13/6315* (2013.01)

(58) Field of Classification Search
CPC ..... H01R 13/6215; H01R 13/631; H01R 13/514; H01R 13/506; H01R 13/6315; H01R 13/516; H01R 13/518
(Continued)

(56) References Cited

U.S. PATENT DOCUMENTS 5,913,703 A 6/1999 Suzuki et al.
6,027,360 A * 2/2000 Jenkins ..... H01R 13/6215 439/248
(Continued)

FOREIGN PATENT DOCUMENTS

DE 19838492 A1 3/2000
DE 69622082 T2 2/2003
(Continued)

*Primary Examiner* — Gary F Paumen
(74) *Attorney, Agent, or Firm* — Leydig, Voit & Mayer, Ltd.

(57) ABSTRACT

A plug-in connector part for plug-in connection to an associated mating plug-in connector part includes: a holder frame; and a plurality of modular contact inserts inserted into the holder frame which each include a plug-in portion for connecting to the mating plug-in connector part in a plug-in direction and have a contact element arranged thereon for contacting the mating plug-in connector part. At least one of the contact inserts includes a module housing inserted into the holder frame and a contact support which is arranged on the module housing, is movable relative to the module housing in the plug-in direction, and forms the plug-in portion of the contact insert.

11 Claims, 4 Drawing Sheets

(51) Int. Cl.
*H01R 13/516* (2006.01)
*H01R 13/518* (2006.01)
*H01R 13/631* (2006.01)

(58) Field of Classification Search
USPC ..... 439/364, 701, 247, 248
See application file for complete search history.

(56) References Cited

U.S. PATENT DOCUMENTS

| | | | | |
|---|---|---|---|---|
| 6,241,551 | B1 | 6/2001 | Watanabe | |
| 6,986,676 | B1 * | 1/2006 | Tronolone | H01R 13/514 439/247 |
| 7,121,888 | B2 * | 10/2006 | Brandt | H01R 13/512 439/607.05 |
| 7,597,562 | B2 | 10/2009 | Genesius et al. | |
| 2005/0272285 | A1 | 12/2005 | Kressmann et al. | |
| 2006/0292932 | A1 | 12/2006 | Benham et al. | |
| 2011/0281451 | A1 * | 11/2011 | Tanis | H01R 13/6315 439/248 |
| 2016/0276778 | A1 | 9/2016 | Beischer et al. | |

FOREIGN PATENT DOCUMENTS

| | | | |
|---|---|---|---|
| DE | 202010005095 | U1 | 8/2011 |
| DE | 202012103360 | U1 | 1/2013 |
| DE | 102012110907 | A1 | 5/2014 |
| JP | 2007134237 | A | 5/2007 |
| KR | 101500214 | B1 | 3/2015 |
| WO | WO 2010041103 | A1 | 4/2010 |
| WO | WO 2014199835 | A1 | 12/2014 |

* cited by examiner

PLUG-IN CONNECTOR PART HAVING MODULAR CONTACT INSERTS INSERTED INTO A HOLDING FRAME

CROSS-REFERENCE TO PRIOR APPLICATIONS

This application is a U.S. National Phase application under 35 U.S.C. § 371 of International Application No. PCT/EP2017/057854, filed on Apr. 3, 2017, and claims benefit to German Patent Application No. DE 10 2016 107 412.8, filed on Apr. 21, 2016. The International Application was published in German on Oct. 26, 2017 as WO 2017/182257 under PCT Article 21(2).

FIELD

The invention relates to a plug-in connector part for plug-in connection to an associated mating plug-in connector part.

BACKGROUND

A plug-in connector part of this kind comprises a holder frame and a plurality of modular contact inserts inserted into the holder frame which each have a plug-in portion which can be connected to the mating plug-in connector part in a plug-in direction and has a contact element arranged thereon for contacting the mating plug-in connector part.

Holder frames of this kind are suitable for the modular receipt of contact inserts, for example on plug-in connectors. One or more contact inserts may be arranged on a holder frame of this kind in order to be inserted into a housing of a plug-in connector part, together with the holder frame, and to be connected to the housing. In this way, contact inserts can be combined in a modular manner and can be arranged in or on a plug-in connector part by means of the holder frame.

Contact inserts of this kind may comprise for example one or more electrical contacts. In this case, the contact inserts are connected to electrical lines supplied to a plug-in connector, and form plug-in contacts by means of which the plug-in connector can be brought into a plug-in engagement with a mating plug-in connector part in order to provide electrical contacting therewith.

Modular contact inserts of this kind offer the advantage of flexible combinability, thus allowing plug-in connectors to be used in various ways.

Plug-in connector parts having a holder frame which receives modular contact inserts are known from DE 10 2012 110 907 A1 or DE 20 2012 103 360 U1, for example.

A plug-in connector part using a holder frame of this kind to receive modular contact inserts may be used in a switch cabinet, for example. A switch cabinet of this kind can for example have a slot into which an electrical device can be pushed in order to automatically come into contact with the switch cabinet upon being pushed in. For this purpose, for example a plug-in connector part can be arranged on the electrical device, which part comes into plug-in engagement with an associated mating plug-in connector part upon being pushed into the slot in the switch cabinet and thus establishes electrical contacting.

In the case of slot systems of this kind, plug-in connectors are required which can compensate for relatively large manufacturing tolerances and which encounter one another automatically.

In addition, it can be advantageous for different contact inserts to make contact in different positions in order to distribute the contacting of contact elements of the plug-in connector part with associated mating contact elements of the mating plug-in connector part over time, and thus for some contact elements to make contact before other contact elements. For this purpose, it has conventionally been provided for different contact elements to have different lengths, as is the case for example in a plug-in connector known from DE 198 38 492 A1. During plug-in connection of a plug-in connector part to an associated mating plug-in connector part, longer contact elements come into engagement with associated mating contact elements before shorter contact elements, meaning that the contacting is staggered.

DE 20 2010 005 095 A1 discloses a plug-in connector part in which contact inserts are received on a holder frame. Guide pins are arranged on the holder frame which are longer than the contact inserts received on the holder frame, meaning that, when the plug-in connector part is plugged into an associated mating plug-in connector part, the guide pins come into engagement with guide receptacles before the contact inserts come into engagement with associated mating contact inserts on the mating plug-in connector part side. This leading engagement results in the plug-in connector part and the mating plug-in connector part being guided on one another before an electrically contacting engagement is established.

SUMMARY

In an embodiment, the present invention provides a plug-in connector part for plug-in connection to an associated mating plug-in connector part, comprising: a holder frame; and a plurality of modular contact inserts inserted into the holder frame which each comprise a plug-in portion configured to be connected to the mating plug-in connector part in a plug-in direction and have a contact element arranged thereon configured to contact the mating plug-in connector part, wherein at least one of the contact inserts comprises a module housing inserted into the holder frame and a contact support which is arranged on the module housing, is movable relative to the module housing in the plug-in direction, and forms the plug-in portion of the contact insert.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
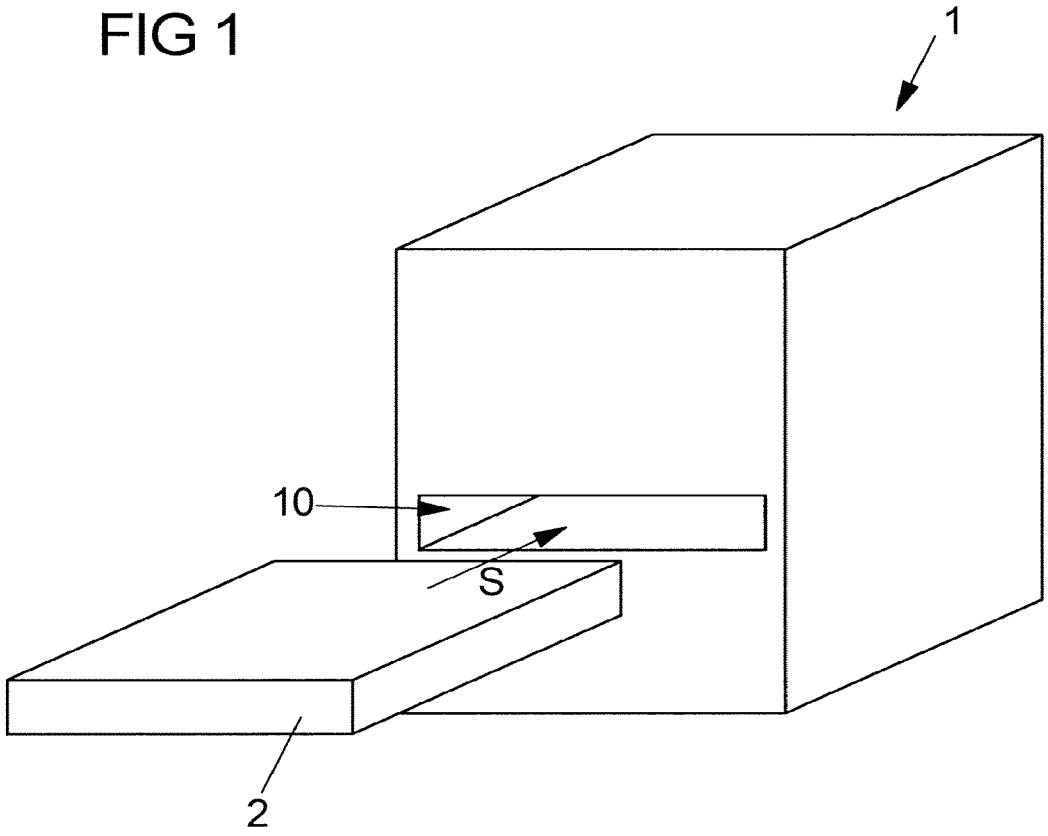
FIG. 1 schematically shows a switch cabinet comprising a slot into which an electrical device can be pushed in the plug-in direction.

In an embodiment, the present invention provides a plug-in connector part which can be produced cost-effectively, can be used in different ways and makes it possible to have leading contacting of at least one contact insert.

According to this, at least one of the contact inserts comprises a module housing inserted into the holder frame and a contact support which is arranged on the module housing, is movable relative to the module housing in the plug-in direction and forms the plug-in portion of the contact insert.

The present invention is based on a plug-in connector part being formed using modular contact inserts. The modular contact inserts can be inserted into a holder frame and, when mounted, are held in the holder frame. The fact that the holder frame can be fitted with different contact inserts allows different, individually adjusted plug-in connector parts to be provided in which a desired combination of contact inserts is inserted into the holder frame such that a plug-in face is created which has electrical contacts, optical contacts and/or pneumatic contacts.

The position of at least one of the contact inserts can be altered in the case of a flexibly adjustable plug-in connector part of this kind. This makes leading contacting of one or more contact inserts possible, meaning that, during plug-in connection of the plug-in connector part to an associated mating plug-in connector part, initially one or more leading contact inserts of the plug-in connector part come into contacting engagement with the mating plug-in connector part before the remaining, trailing contact inserts are contacted. In this way, the contacting is staggered over the course of the plug-in process, which facilitates the plug-in connector part encountering the mating plug-in connector part, and simplifies the contacting.

In order to provide a leading contact insert, at least one of the contact inserts comprises a module housing inserted into the holder frame and a contact support which is arranged on the module housing and is movable relative to the module housing. The contact insert therefore has two functions: the connection to the holder frame is established by means of the module housing, while the contact support forming the plug-in portion is movable relative to the module housing and thus makes it possible to adjust the position of the contact insert. The module housing is received so as to be stationary on the holder frame. In contrast, the contact support is movable on the module housing in order to thus adjust the position of the plug-in portion on the contact support relative to the holder frame.

In one embodiment, the contact support is spring-preloaded with respect to the module housing in the plug-in direction. In an initial position, the contact support is thus in a first position on the module housing, out of which the contact support can be shifted counter to the spring-preloading in order to adjust the position of the plug-in portion for example during the plug-in engagement of the plug-in connector part and the mating plug-in connector part.

The contact support having the plug-in portion formed thereon is preferably movably guided in a housing opening in the module housing. The contact support is inserted into the module housing and guided on the module housing in the plug-in direction. The position of the contact support can thus be adjusted relative to the module housing in the plug-in direction.

In this case, the contact support comprises for example a support member which is positioned in the housing opening and is guided along a predetermined distance on the module housing by engagement of a guide element arranged on the support member or the module housing in a guide opening arranged in the module housing or the support member. For example, in a specific embodiment, a guide element can be arranged on the support member in the form of a projection and can engage in a guide opening in the module housing. The guide opening has for example the shape of an elongate hole that extends in the plug-in direction such that the guide element can be moved in the guide opening in the plug-in direction, and the movement path of the contact support relative to the module housing is determined by the engagement of the guide element in the guide opening.

On account of the fact that the contact support is movable relative to the module housing in the plug-in direction, it is possible to adjust the position of the plug-in portion formed on the contact support. This can be useful in particular when the plug-in connector part is plugged into an associated mating plug-in connector part, for example in order to allow individual plug-in portions to come into leading engagement with associated plug-in portions on the mating plug-in connector part.

For example, in a first position of the contact support, the plug-in portion of the contact support of the at least one of the contact inserts can protrude with respect to a plug-in portion of at least one other contact insert in the plug-in direction. Thus, in an initial position, the plug-in portion formed on the movable contact support protrudes with respect to other plug-in portions on other contact inserts in the plug-in direction. If the plug-in connector part is attached to an associated mating plug-in connector part in the plug-in direction, the protruding plug-in portion on the movable contact support of the at least one of the contact inserts thus comes into engagement with the mating plug-in connector part before other plug-in portions of other contact inserts come into engagement with the mating plug-in connector part.

Whereas the contact support having the plug-in portion arranged thereon of the at least one of the contact inserts is movable relative to the module housing, and thus the position thereof can be adjusted, the plug-in portions of other contact inserts are arranged so as to be immovable with respect to the holder frame. The plug-in portions of these other contact inserts cannot therefore be adjusted in terms of their position relative to the holder frame, but instead are held on the holder frame so as to be stationary.

A spring element which preloads the contact support relative to the module housing preferably acts between the contact support and the module housing of the at least one of the contact inserts. If the contact support is moved out of its first position relative to the module housing, this is counter to the spring force of the spring element, and therefore a restoring force acts in the direction of the first position. The spring element is supported on the contact support, for example, and is subjected to pressure when the contact support moves relative to the module housing counter to the plug-in direction. If the contact support is moved out of its first position, the spring element is thus compressed and, as result, imparts a spring force on the contact support in the direction of the first position.

If the plug-in connector part is attached to an associated mating plug-in connector part, the contact support of the at least one of the contact inserts is therefore—before attaching the plug-in connector part to the mating plug-in connector part—preferably in the first position. In this first position, the plug-in portion of the contact support of the at least one of the contact inserts protrudes for example with respect to other plug-in portions of other contact inserts in the plug-in direction.

If the plug-in connector part is attached to the mating plug-in connector part, the protruding plug-in portion of the contact support of the at least one of the contact inserts initially comes into engagement with the mating plug-in connector part before the plug-in portions of other contact inserts come into engagement with the mating plug-in connector part. This can facilitate the attachment of the plug-in connector part to the mating plug-in connector part because, initially, the plug-in portion of the movable contact support encounters the mating plug-in connector part before the other plug-in portions also come into engagement with the mating plug-in connector part. The contacting with the mating plug-in connector part therefore takes place in an offset, staggered manner, which can also reduce the force required to plug the plug-in connector part into the mating plug-in connector part.

The spring force acting between the contact support and the module housing of the at least one of the contact inserts is dimensioned such that, when the plug-in connector part is attached to the mating plug-in connector part, the plug-in portion of the movable contact support can be pressed into engagement with the mating plug-in connector part. The spring force of the preloading spring element is therefore large enough that the force required to plug the plug-in portion into the mating plug-in connector part can be overcome. When attaching the plug-in connector part to the mating plug-in connector part, the plug-in portion thus initially slides into the mating plug-in connector part without in the process being noticeably shifted relative to the module housing in the plug-in direction.

If the plug-in portion of the movable, leading contact support is fully plugged into the mating plug-in connector part, upon further attachment of the plug-in connector part to the mating plug-in connector part, the contact support is shifted relative to the module housing, and the spring element acting between the contact support and the module housing is tensioned until, when the plug-in connector part is fully plugged into the mating plug-in connector part, all the contact inserts of the plug-in connector part are in engagement with the mating plug-in connector part.

When the plug-in connector part is fully plugged in, the plug-in portion of the movable contact support is moved out of the first position counter to the plug-in direction and is found in a second position in which the plug-in portion is for example approximately at the same level as the plug-in portions of the other contact inserts.

If the plug-in connector part is removed from the mating plug-in connector part, the plug-in portions of the other contact inserts, of which the position cannot be changed, are initially pulled out of the mating plug-in connector part before—now trailing—the plug-in portion of the movable contact support is also brought out of engagement with the mating plug-in connector part. The plug-in portion of the contact support, which is movable relative to the module housing, is therefore pulled out of the mating plug-in connector part in a trailing manner such that the contacting of the plug-in connector part with the mating plug-in connector part is released in a staggered manner.

In principle, one or more contact inserts can be designed to each have a module housing and a contact support that is movable relative to the module housing. It is also conceivable for all the contact inserts to be designed to have a module housing of this kind and a contact support that is movable relative to the module housing. Advantageously, however, some contact inserts may be designed to have a contact support of which the position can be adjusted, whereas other contact inserts may be designed to have stationary plug-in portions.

FIG. 1 schematically shows a switch cabinet 1 comprising a slot 10. The switch cabinet 1 may be a component of a low-voltage switchgear, for example, and can comprise a plurality of slots 10 into which different electrical devices 2 can be pushed.

The electrical device 2 can be pushed into an associated slot 10 in a plug-in direction S. The slot 10 can in this case provide a mechanical guide for the electrical device 2, such that the electrical device 2 can be pushed into the slot 10 and thus into the switch cabinet 1 in a guided manner in the plug-in direction S after insertion into the slot 10.

Figure 2:
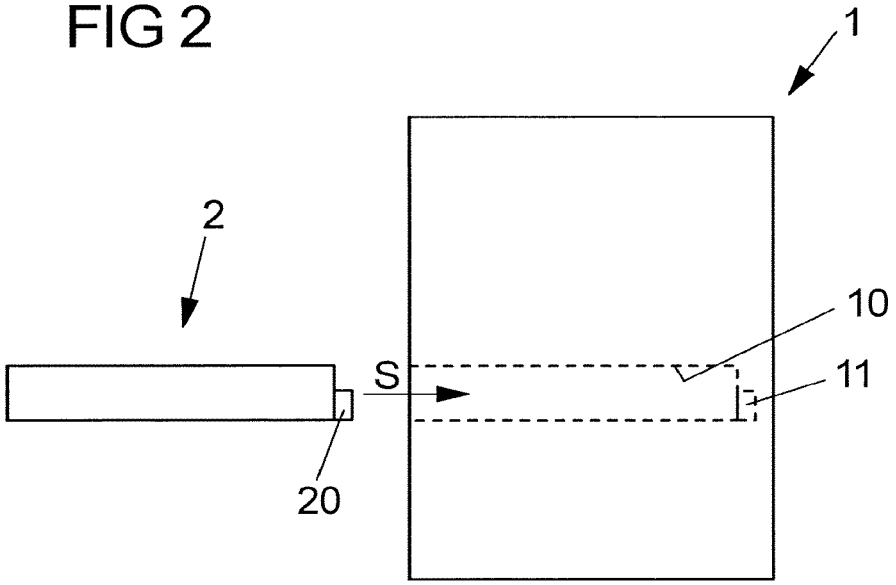
FIG. 2 is a schematic side view of the arrangement according to FIG. 1.

As schematically shown in FIG. 2, a plug-in connector part 20 can be arranged on the electrical device 2, which part automatically comes into engagement with an associated mating plug-in connector part 11 inside the slot 10 when the electrical device 2 is pushed into the associated slot 10 in the switch cabinet 1, and electrical contacting is thus established between the electrical device 2 and electrical or electronic assemblies inside the switch cabinet 1. The contacting takes place automatically when the electrical device 2 is pushed into the switch cabinet 1 without particular measures for plug-in connection of the plug-in connector part 20 to the mating plug-in connector part 11 having to be taken by an installer.

Because switch cabinets 1 and electrical devices 2 are produced with significant tolerances, it is necessary to design a plug-in connector part 20 on an electrical device 2, exactly as with an associated mating plug-in connector part 11 on a switch cabinet 1, in such a way that the plug-in connector part 20 can encounter the mating plug-in connector part 11 in a simple and precisely aligned manner when the electrical device 2 is pushed into the switch cabinet 1. This encounter has to take place with compensation for the manufacturing tolerances.

Figure 3:
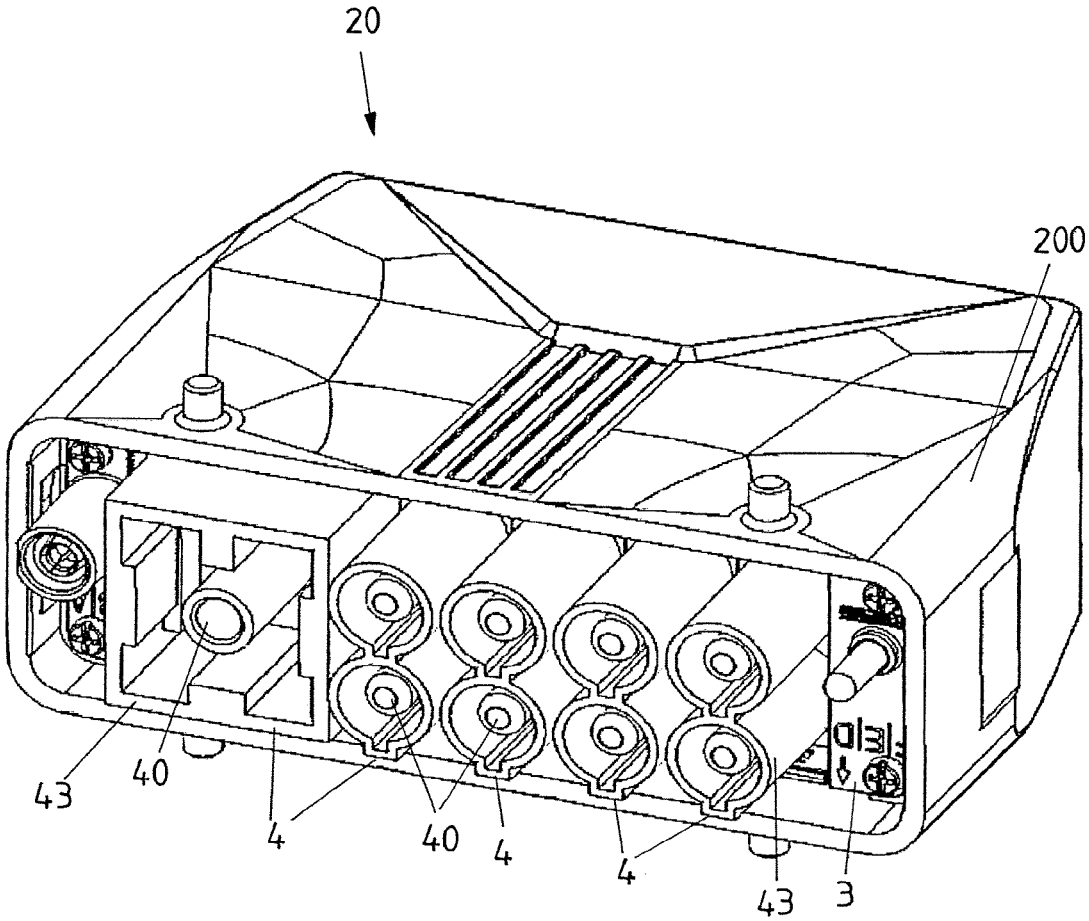
FIG. 3 shows a plug-in connector part having a holder frame and contact inserts inserted therein.

FIG. 3 schematically shows an embodiment of a plug-in connector part 20 comprising a housing 200 and a holder frame 3 inserted into the housing 200. For example, an electrical line in which a plurality of electrical line wires can be enclosed which open into the housing 200 can be inserted into the housing 200 in order to thus electrically contact modular contact inserts 4 which are arranged on the holder frame 3.

Figure 4:
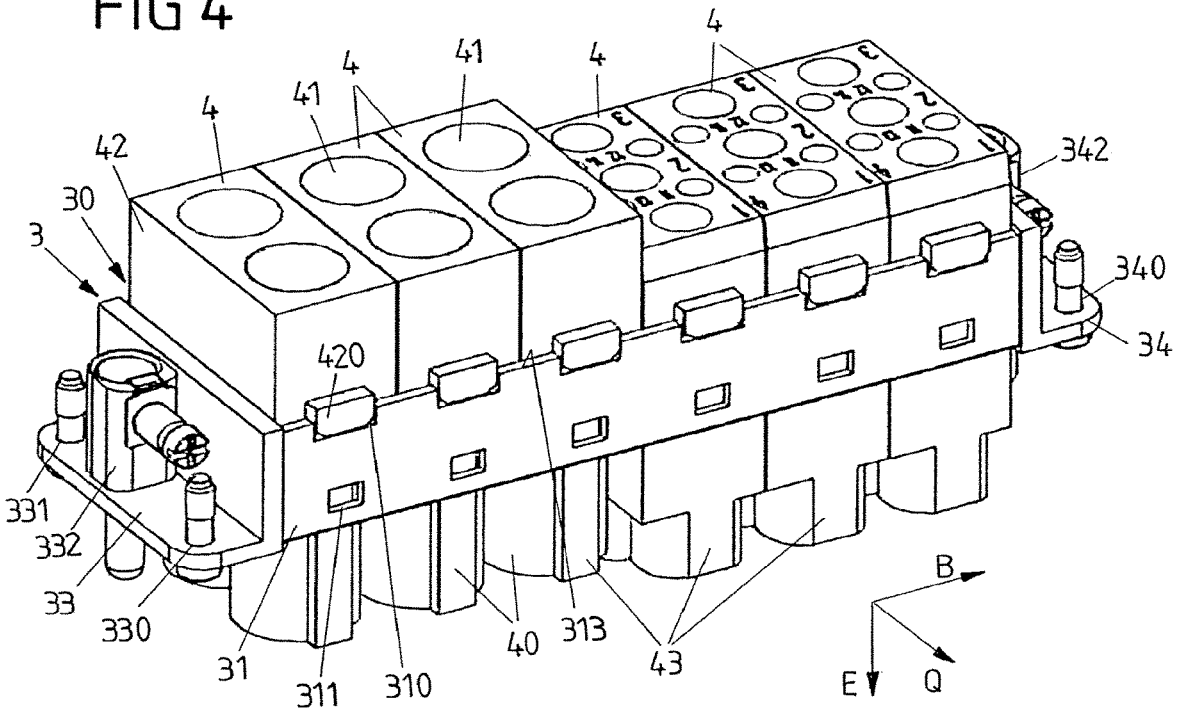
FIG. 4 shows a holder frame having contact inserts attached thereon.
Figure 5:
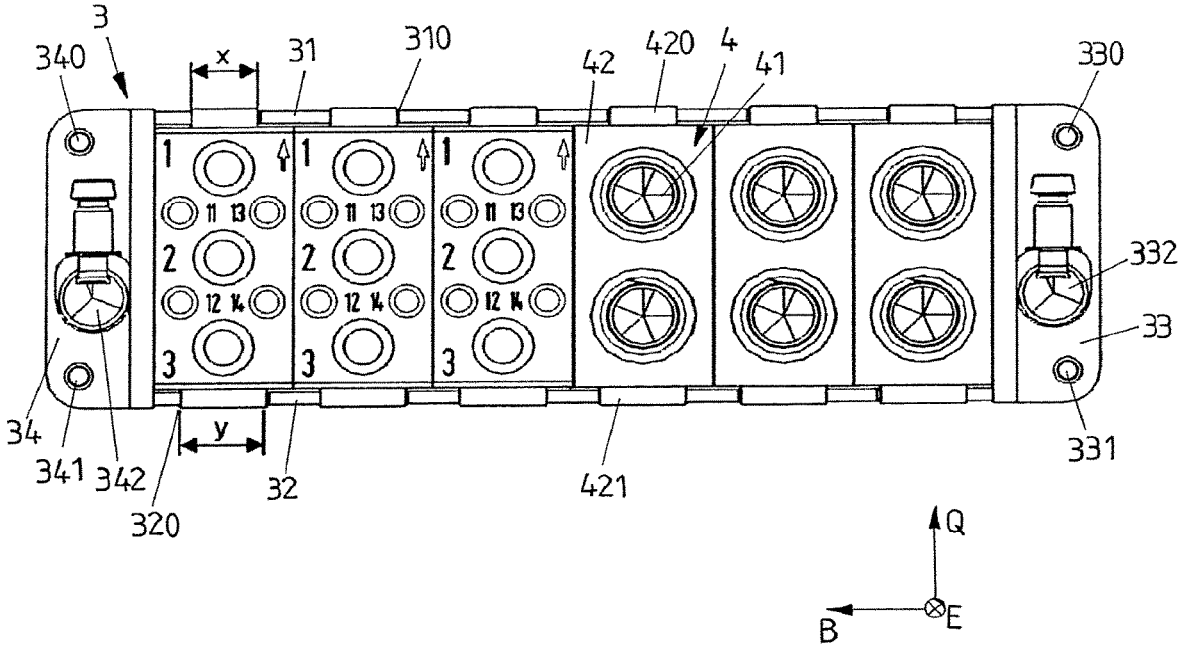
FIG. 5 shows the arrangement according to FIG. 4 from above.

The holder frame 3 is used to receive modular contact inserts 4, as shown in a specific embodiment in FIG. 4 and FIG. 5. The contact inserts 4 are attached to the holder frame 3 and comprise—on outwardly protruding plug-in portions 43—contact elements 40 which are used for plug-in connection to and electrical contacting with associated mating contact elements of the mating plug-in connector part 11.

As can be seen from FIGS. 4 and 5, the contact inserts 4 have a modular design and can differ greatly from one another. The contact inserts 4 each comprise a housing body 42 which comprises plug-in openings 41 on a side facing the housing 200 of the plug-in connector part 20, in which openings the line wires of a line for electrical contacting can be inserted. Plug-in portions 43 having contact elements 40 protrude from the housing body 42 on the opposite, outward-facing side, which elements are used for plug-in engagement with the mating plug-in connector part 11.

The contact inserts 4 can differ in terms of the shape of the contact elements 40, the number of contact elements 40 or also in terms of the basic function thereof. For example, not only electrical contacts, but also mechanical or pneumatic contacts can be provided by means of the contact inserts 4, for example.

The contact inserts 4 can be attached to a holder frame 3 in a modular manner in various combinations. The holder frame 3 comprises frame walls 31, 32 which extend in parallel with one another in a width direction B, which are mutually spaced in a depth direction Q and which receive the contact inserts 4 therebetween. The frame walls 31, 32 are interconnected at the ends by wall parts 33, 34 such that a rectangular frame having an opening 30 is formed, into which opening the contact inserts 4 can be inserted in an insertion direction E.

The contact inserts 4 have an identical pitch in the width direction B, in particular an identical width.

Recesses 310, 320 are made—opposite one another in pairs—in the frame walls 31, 32, respectively, into which recesses the contact inserts 4 having projection elements 420, 421 can be pushed such that, when contact inserts 4 are arranged in the holder frame 3, the contact inserts 4 come to be positioned, by means of the projection elements 420, 421 thereof, in each case in a pair of opposing recesses 310, 320.

The recesses 310, 320 in the opposing frame walls 31, 32 have—measured in the width direction B—different widths x, y (see FIG. 5). This allows coding to be created, which makes it possible to insert a contact insert 4 only in a predetermined position and orientation in a plug-in place created between the frame walls 31, 32. Thus, a first, narrow—measured in the width direction B—projection element 420 is pushed into the recesses 310 in the first frame wall 31, whereas a second projection element 421 arranged on the other, opposite side of the housing body 42 can be inserted only into the recess 320 in the second frame wall 32 on account of the width y thereof.

Fastening points 330, 331, 340, 341 are provided on the end wall parts 33, 34 and are used to fasten the holder frame 3 to the housing 200 of the plug-in connector part 20 and make it possible to secure the holder frame 3 having contact inserts 4 arranged thereon to the housing 200, for example by means of suitable screw connections.

Connection means 332, 342 by means of which for example a neutral conductor can be connected to the holder frame 3 are also provided on the end wall parts 33, 34.

The embodiment of the plug-in connector part 20 according to FIGS. 3 to 5 is used for the purposes of illustration, but should not be understood to limit the present invention.

In the case of a plug-in connector part 20 embodying the present invention, at least one of the contact inserts 4 is designed such that the position of the plug-in portion 43 of this contact insert 4 can be adjusted in the plug-in direction S. This makes it possible to provide plug-in portions 43 which are leading with respect to other plug-in portions 43 of other contact inserts 4, such that, when the plug-in connector part 20 is plugged into an associated mating plug-in connector part 11, plug-in portions 43 of some contact inserts 4 come into engagement with the mating plug-in connector part 11 before plug-in portions 43 of other contact inserts 4.

Figure 6A:
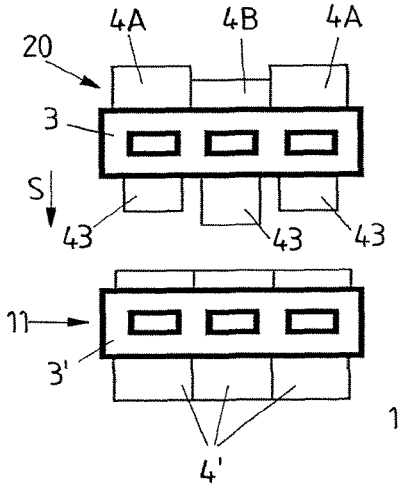
FIG. 6A schematically shows a plug-in connector part before attachment to an associated mating plug-in connector part.
Figure 6B:
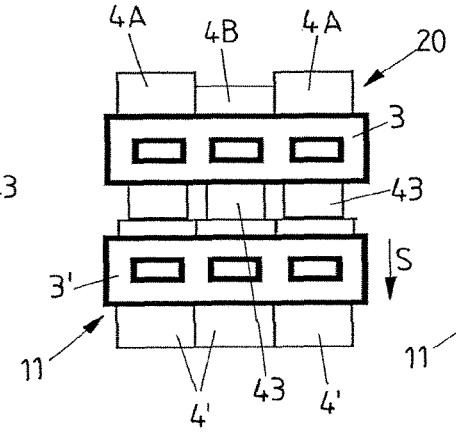
FIG. 6B schematically shows the plug-in connector part during attachment to the associated mating plug-in connector part.
Figure 6C:
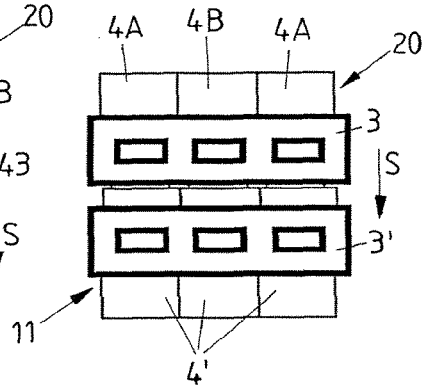
FIG. 6C schematically shows the plug-in connector part fully plugged into the associated mating plug-in connector part.

This shown schematically in FIGS. 6A to 6C.

Thus, on the one hand, a plug-in connector part 20 can comprise contact inserts 4A which are arranged so as to be stationary on the holder frame 3 and of which the position, together with that of the plug-in portions 43 thereof, cannot be changed in the plug-in direction S. On the other hand, at least one contact insert 4B is designed such that the position of the plug-in portion 43 of this contact insert 4B can be adjusted in the plug-in direction S. This makes it possible to bring the plug-in portion 43 of the contact insert 4B into engagement with contact inserts 4' arranged on a holder frame 3' of the mating plug-in connector part 11 so as to be leading before the plug-in portions 43 of the other contact inserts 4A.

In an initial position, as shown in FIG. 6A, the plug-in portion of the contact insert 4B protrudes with respect to the plug-in portions 43 of the other contact inserts 4A in the plug-in direction S.

If, as shown in FIG. 6B, the plug-in connector part 20 is attached to the associated mating plug-in connector part 11 in the plug-in direction S, initially the plug-in portion 43 of the contact insert 4B comes into engagement with an associated contact insert 4' of the mating plug-in connector part 11 and contacts said contact insert 4'.

If the plug-in connector part 20 is plugged further into the mating plug-in connector part 11 in the plug-in direction S, then the plug-in portions 43 of the other contact inserts 4A also ultimately come into engagement with the mating plug-in connector part 11, the plug-in portion 43 of the contact insert 4B moving relative to the holder frame 3 counter to the plug-in direction S and thus being aligned in terms of its position with respect to the plug-in portions 43 of the other contact inserts 4A. This is shown schematically in FIG. 6C.

When pulling the plug-in connector part 20 out of the mating plug-in connector part 11, this works in precisely the opposite way. Initially, the plug-in connector part 20 together with the plug-in portions 43 of the contact inserts 4A is pulled out of the contact inserts 4' of the mating plug-in connector part 11 counter to the plug-in direction S, the plug-in portion 43 of the contact insert 4B initially remaining in the associated contact insert 4' of the mating plug-in connector part 11, as shown in FIG. 6B. If the plug-in connector part 20 is pulled out further, the plug-in portion 43 of the contact insert 4B also ultimately comes out of engagement with the mating plug-in connector part 11 until the plug-in connector part 20 is finally completely separated from the mating plug-in connector part 11, as shown in FIG. 6A.

Figure 7:
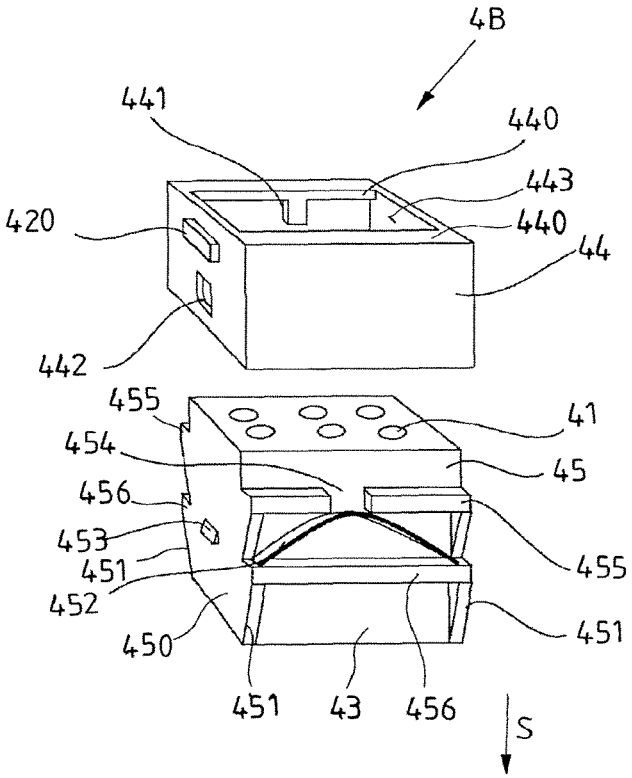
FIG. 7 is a schematic, perspective view of an embodiment of a contact insert, comprising a module housing and a contact support that is movable relative to the module housing.

An embodiment of a contact insert 4B comprising a plug-in portion 43 of which the position can be adjusted in the plug-in direction S is shown in FIG. 7.

The contact insert 4B comprises a module housing 44 which can be firmly inserted into the holder frame 3 and is immovably held in position on the holder frame 3 when inserted. Projection elements 420 protrude outwards from both sides of the module housing 44, by means of which elements the module housing 44 can be inserted into the recesses 310, 320 in the frame walls 31, 32 of the holder frame 3.

A contact support 45 is guided in a housing opening 443 in the module housing 44 so as to be movable in the plug-in direction S. The contact support 45 comprises a support member 450 which is positioned in the housing opening 443 and from which a guide element 453 in the form of a projection which engages in guide openings 442 on both sides of the module housing 44 protrudes on both sides, transversely to the plug-in direction S. By means of the guide elements 453 and the engagement thereof in the guide openings 442 which are on both sides and in the form of elongate holes, the movement path of the contact support 45 inside the housing opening 443 in the module housing 44 is limited such that the contact support 45 can be moved relative to the module housing 44 between a first, protruding position and a second, pushed-in position.

The contact support 45 forms the plug-in portion 43 on which contact elements 40 are arranged, similarly to as can be seen from FIG. 3. Plug-in openings 41 into which electrical lines can be inserted for electrically contacting a contact element arranged on the plug-in portion 43 are arranged on a side remote from the plug-in portion 43.

A spring element 452 is arranged at both the front and the rear of the contact support 45, which element is supported on a bearing ridge 456 on the contact support 45 and is used to provide spring preloading between the contact support 45 and the module housing 44. The bearing ridge 456 extends transversely on the support member 450 and is supported by means of ribs 451.

The spring elements 452 are each arranged between the bearing ridge 456 and an upper ridge 455, in which an opening 454 is formed through which an associated pressure bar 441 of the module housing 44 engages. The pressure bar 441 extends from an upper edge 440 of the module housing 44 into the housing opening 443 in the plug-in direction S and is used to compress the associated spring element 452 when the contact support 45 is shifted relative to the module housing 44 counter to the plug-in direction S in order to impart a restoring force on the contact support 45 in the plug-in direction S.

If, as described on the basis of FIGS. 6A to 6C, the plug-in connector part 20 together with the plug-in portion 43 arranged on the contact support 45 is plugged into the associated mating plug-in connector part 11 in the plug-in direction S, the plug-in portion 43 comes into contacting engagement with an associated contact insert 4' on the mating plug-in connector part 11 side. The spring force provided by the spring elements 452 is in this case dimensioned such that, when plugging the plug-in connector part 20 into the mating plug-in connector part 11, the plug-in portion 43 can be pushed into the contact insert 4' of the mating plug-in connector part 11 without the spring elements 452 (initially) being (significantly) compressed.

Only upon full plug-in of the mating plug-in connector part 20 into the associated mating plug-in connector part 11 is the contact support 45 moved relative to the module housing 44 counter to the plug-in direction S, as shown schematically in FIG. 6C. In this case, the spring elements 452 are compressed such that a restoring force acts on the contact support 45 in the plug-in direction S.

Thus, if the plug-in connector part 20 is in turn removed from the mating plug-in connector part 11 counter to the plug-in direction S, the plug-in portion 43 of the movable contact support 45 initially remains in the associated contact insert 4' of the mating connector part 11, as shown in FIG. 6B, the contact support 45 moving relative to the module housing 44 in the plug-in direction S for this purpose.

If the plug-in connector part 20 is ultimately released further from the mating plug-in connector part 11, the plug-in portion 43 of the contact support 45 comes out of engagement with the associated contact insert 4' of the mating plug-in connector part 11, as shown in FIG. 6A. The plug-in portion 43 is then in turn in the first, protruding position thereof.

Because the position of the plug-in portion 43 of the contact insert 4B can be adjusted when the plug-in connector part 20 is plugged into the associated mating plug-in connector part 11 and because, in addition, the plug-in portion 43 of the adjustable contact insert 4B is leading with respect to the plug-in portions 43 of the other contact inserts 4A, it is possible to easily insert the plug-in connector part 20 into an associated mating plug-in connector part 11 while overcoming manufacturing tolerances. In particular, the plug-in portion 43 of the adjustable contact insert 4B can encounter an associated contact insert 4' before the remaining plug-in portions 43 of the other contact inserts 4A also make contact, and therefore the plug-in portions 43 of the different contact inserts 4A, 4B come into engagement with the associated contact inserts 4' of the mating plug-in connector part 11 in a staggered manner.

The concept on which the invention is based is not limited to the embodiments described above but can in principle also be implemented by quite different embodiments.

In particular, a plug-in connector part of the kind described herein is not limited to the use in a switch cabinet having a slot system. A plug-in connector part of the kind described herein may be employed in a wide range of applications, for example as part of an industrial plant, and may be plugged in automatically, for example as part of a slot system, or also manually.

In principle, completely different designs of holder frames having modular contact inserts that can be arranged thereon are additionally conceivable and possible.

Completely different contact elements can constitute the modular contact inserts, for example electrical contacts, optical contacts, pneumatic contacts or even contacts of a completely different nature.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Switch cabinet
10 Slot

11 Mating plug-in connector part
2 Electrical device
20 Plug-in connector part
200 Housing
3, 3' Holder frame
30 Opening
31, 32 Frame wall (limb)
310, 320 Recess
311, 321 Holding opening
33, 34 Wall part
330, 331, 340, 341 Fastening points
332, 342 Connection means
4, 4A, 4B, 4' Modular contact inserts
40 Contact elements
41 Plug-in openings
42 Housing body
420, 421 Projection element
43 Plug-in portion
44 Module housing
440 Edge element
441 Pressure bar
442 Guide opening
443 Housing opening
45 Contact support
450 Support member
451 Rib
452 Spring element
453 Guide element
454 Opening
455 Ridge
456 Bearing ridge
B Width direction
E Insertion direction
S Plug-in direction
Q Depth direction
x, y Width

The invention claimed is:

1. A plug-in connector part for plug-in connection to an associated mating plug-in connector part, comprising:

a holder frame; and a plurality of modular contact inserts inserted into the holder frame which each comprise a plug-in portion configured to be connected to the mating plug-in connector part in a plug-in direction and have a contact element arranged thereon configured to contact the mating plug-in connector part, wherein at least one of the contact inserts comprises a module housing inserted into the holder frame and a contact support which is arranged on the module housing, is movable relative to the module housing in the plug-in direction, and forms the plug-in portion of the contact insert, and wherein the contact support is spring-preloaded with respect to the module housing in the plug-in direction.

2. The plug-in connector part according to claim 1, wherein the contact support of the at least one of the contact inserts is inserted into a housing opening in the module housing so as to be movable in the plug-in direction and is guided in the housing opening in the module housing in the plug-in direction.

3. The plug-in connector part according to claim 2, wherein the contact support comprises a support member which is positioned in the housing opening and is guided along a predetermined distance on the module housing by engagement of a guide element arranged on the support member or the module housing in a guide opening arranged in the module housing or the support member.

4. The plug-in connector part according to claim 1, wherein, in a first position of the contact support, the plug-in portion of the contact support of the at least one of the contact inserts is configured to protrude with respect to a plug-in portion of at least one other contact insert in the plug-in direction.

5. The plug-in connector part according to claim 4, wherein the plug-in portion of the at least one other contact insert is arranged so as to be immovable with respect to the holder frame.

6. The plug-in connector part according to claim 4, wherein the contact support of the at least one of the contact inserts is movable relative to the module housing out of the first position, counter to the plug-in direction, against a spring force of a spring element acting between the contact support and the module housing.

7. The plug-in connector part according to claim 6, wherein the spring element is supported on the contact support and is subjected to pressure when the contact support is moved relative to the module housing counter to the plug-in direction.

8. An assembly, comprising:

the plug-in connector part according to claim 4; and a mating plug-in connector part configured to be connected to the plug-in connector part, wherein the contact support of the at least one of the contact inserts is in the first position before attachment of the plug-in connector part to the mating plug-in connector part.

9. The assembly according to claim 8, wherein, when the plug-in connector part is attached to the mating plug-in connector part, the plug-in portion of the contact support of the at least one of the contact inserts comes into engagement with the mating plug-in connector part before the plug-in portion of the at least one other contact insert comes into engagement with the mating plug-in connector part.

10. The assembly according to claim 8, wherein, when the plug-in connector part is attached to the associated mating plug-in connector part, the contact support of the at least one of the contact inserts is moved relative to the module housing out of the first position, counter to the plug-in direction.

11. The assembly according to claim 8, wherein, when the plug-in connector part is fully plugged into the mating plug-in connector part, the contact support of the at least one of the contact inserts is in a second position which, with respect to the first position, is shifted relative to the module housing counter to the plug-in direction.

* * * * *